US009289663B1

(12) United States Patent
Bollinger

(10) Patent No.: US 9,289,663 B1
(45) Date of Patent: Mar. 22, 2016

(54) BALL RECOVERY AND RELEASE SYSTEM

(71) Applicant: Robby Reuben Bollinger, Thornton, CO (US)

(72) Inventor: Robby Reuben Bollinger, Thornton, CO (US)

( * ) Notice: Subject to any disclaimer, the term of this patent is extended or adjusted under 35 U.S.C. 154(b) by 0 days.

(21) Appl. No.: 14/543,707

(22) Filed: Nov. 17, 2014

Related U.S. Application Data

(60) Provisional application No. 61/905,604, filed on Nov. 18, 2013.

(51) Int. Cl.

| | |
|---|---|
| ***A63B 67/00*** | (2006.01) |
| ***A63B 69/00*** | (2006.01) |
| ***A63B 63/08*** | (2006.01) |
| *A63B 63/00* | (2006.01) |
| *A63B 24/00* | (2006.01) |
| *A63B 71/02* | (2006.01) |
| *A63B 47/00* | (2006.01) |

(52) U.S. Cl.
CPC ..... *A63B 63/083* (2013.01); *A63B 24/0021* (2013.01); *A63B 24/0075* (2013.01); *A63B 47/002* (2013.01); *A63B 69/004* (2013.01); *A63B 69/0071* (2013.01); *A63B 71/022* (2013.01); *A63B 2063/001* (2013.01)

(58) Field of Classification Search
CPC ..... A63B 24/0075; A63B 69/0071; A63B 24/0021; A63B 69/004; A63B 63/083; A63B 47/002; A63B 71/022; G09B 19/0038
USPC ..... 473/422, 434–436, 447, 472, 481–485
See application file for complete search history.

(56) References Cited

U.S. PATENT DOCUMENTS

| | | | | | |
|---|---|---|---|---|---|
| 5,171,009 | A * | 12/1992 | Filewich | A63B 63/083 | 473/433 |
| 5,487,540 | A * | 1/1996 | Bixler | A63B 69/0071 | 473/436 |
| 5,681,230 | A * | 10/1997 | Krings | A63B 69/0071 | 473/433 |
| 5,776,018 | A * | 7/1998 | Simpson | A63B 24/0021 | 473/433 |
| 8,128,517 | B2 * | 3/2012 | Blair | A63B 63/083 | 473/433 |
| 8,845,460 | B1 * | 9/2014 | Feldstein | A63B 69/0071 | 473/447 |
| 9,017,188 | B2 * | 4/2015 | Joseph | A63B 24/0075 | 473/422 |
| 2004/0162165 | A1 * | 8/2004 | Tien | A63B 63/083 | 473/447 |
| 2010/0056307 | A1 * | 3/2010 | Campbell | A63B 69/0071 | 473/447 |
| 2010/0113189 | A1 * | 5/2010 | Blair | A63B 63/083 | 473/447 |
| 2010/0267496 | A1 * | 10/2010 | Johnson | A63B 69/0071 | 473/447 |
| 2015/0051023 | A1 * | 2/2015 | Aipperspach | A63B 69/0071 | 473/447 |

* cited by examiner

*Primary Examiner* — Mitra Aryanpour
(74) *Attorney, Agent, or Firm* — Plager Schack LLP

(57) ABSTRACT

A ball recovery and release system is configured to return a ball that is shot at a basketball structure. The ball recovery and release system includes a swing arm, rotationally connected to the basketball structure and configured to rotate from a back to a front of the basketball structure. A recovery rim is connected to the swing arm and further attached to a chute configured to direct the ball shot at the basketball structure. A plurality of net frame pole pivot brackets is attached to the recovery rim. A plurality of net frame poles is attached to a net frame pole pivot bracket. A recovery net is connected to all of the net frame poles. The ball is shot at the basketball structure and travels through the recovery net and down the chute.

6 Claims, 5 Drawing Sheets

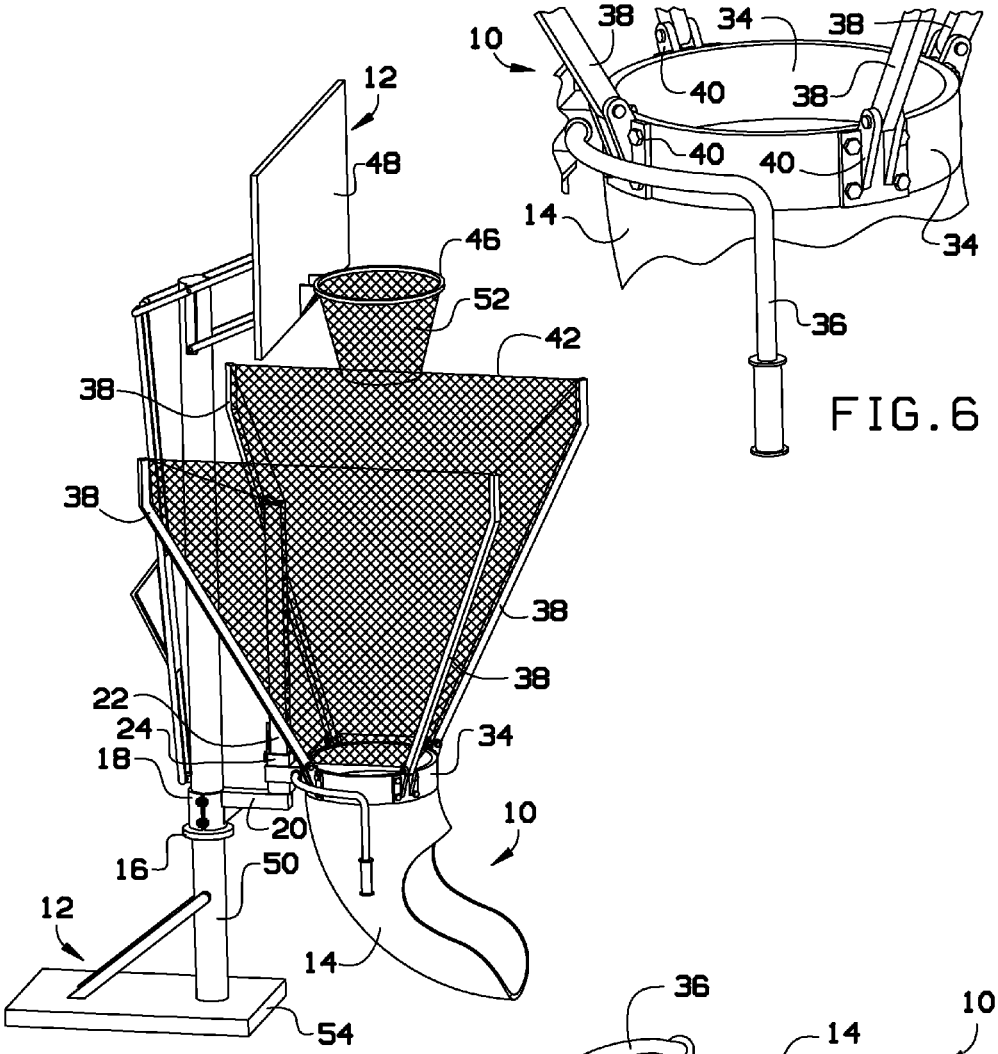
FIG.5
FIG.6
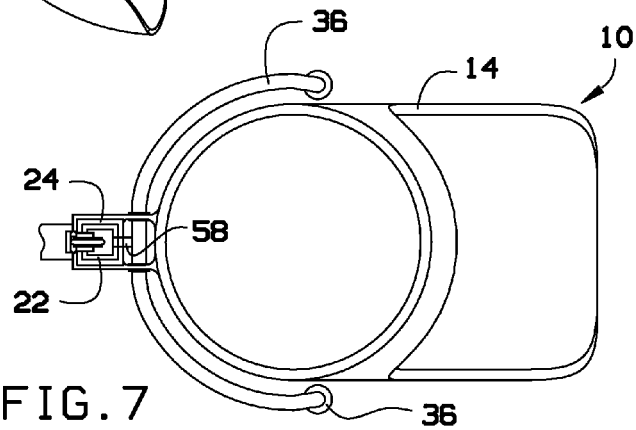
FIG.7

BALL RECOVERY AND RELEASE SYSTEM

RELATED APPLICATION

This application claims priority to provisional patent application U.S. Ser. No. 61/905,604 filed on Nov. 18, 2013, the entire contents of which is herein incorporated by reference.

BACKGROUND

The embodiments herein relate generally to sports equipment.

Prior to embodiments of the disclosed invention, in order to increase a basketball player's percentage of completed goals from a specified place on the basketball court; the basketball player must perfect the mechanical form of their shot by shooting the basketball repeatedly from the same specified place on the basketball court without interruption.

The percentage of completed goals was difficult to increase, if there was no means to rebound and return the basketball without interruption to the basketball player after shooting the basketball. With no means to rebound and return the basketball to the basketball player after the basketball was shot, the basketball player was forced to leave the specified place from which the basketball was shot in order to rebound and retrieve the shot basketball for the player. By leaving the place from which the basketball was shot, in order to rebound and retrieve the basketball for them self, the basketball player's concentration to perfect the mechanical form of their shot was broken. Thus, the opportunity to shoot the basketball repeatedly from the same specified place on the basketball court was lost. Embodiments of the disclosed invention solve this problem.

Other devices must be lifted up to mount and lifted down to dismount from the basketball backboard or rim. Additionally, these devices require a place to store the device while not in use. Embodiments of the present invention mount to a goal pole and swing to the front for use and then swing to the back for storage. Embodiments of the present invention do not need to be dismounted. The advantage is that embodiments of the present invention get used more often, because of its ease of availability and use. Thus, the player's percentage of completed goals are increased.

SUMMARY

A ball recovery and release system is configured to return a ball that is shot at a basketball structure. The ball recovery and release system includes a swing arm, rotationally connected to the basketball structure and configured to rotate from a back to a front of the basketball structure. A recovery rim is connected to the swing arm and further attached to a chute configured to direct the ball shot at the basketball structure. A plurality of net frame pole pivot brackets is attached to the recovery rim. A plurality of net frame poles is attached to a net frame pole pivot bracket. A recovery net is connected to all of the net frame poles. The ball is shot at the basketball structure, captured by the recovery net, travels down the recovery net, and out the chute.

In some embodiments a pole clamp can be attached to the basketball structure. A swing arm pole clamp can rest upon the pole clamp and attached to the swing arm. The swing arm pole clamp can rotate the swing arm around the basketball structure.

In some embodiments, a swing arm guide pole can be mechanically coupled to the swing arm. A swing arm guide pole slide can surround a portion of the swing arm guide pole and configured to slide vertically on the swing arm guide pole. The recovery rim can be attached to the swing arm with the swing arm guide pole slide in order to raise and lower the recovery rim along the swing arm guide pole.

In some embodiments, a lift assist pulley can be attached to the swing arm guide pole. A lift assist swing arm guide pole slide connection can be attached to the swing arm guide pole slide. A lift assist elastic cabling can be connected to the lift assist swing arm guide pole slide connection at one end and stretched up over the lift assist pulley and down the middle of the swing arm guide pole. The lift assist elastic cabling can be mechanically connected at an inside bottom of the swing arm guide pole. The lift assist elastic cabling can create a mechanical advantage for raising and lowering the recovery rim along the swing arm guide pole.

A rim lock and release handle shaft can be mechanically coupled to the swing arm guide pole slide. A swing arm guide pole hole can be drilled in the swing arm guide pole. Rim lock and release handles can be attached to the rim lock and release handle shaft. In a first mode of operation, the rim lock and release handle shaft can be inserted through the swing arm guide pole hole in order to lock the swing arm guide pole slide into a locked position. In a second mode of operation, the rim lock and release handle shaft can be inserted out of the swing arm guide pole hole in order to unlock the swing arm guide pole slide into an unlocked position.

BRIEF DESCRIPTION OF THE FIGURES

The detailed description of some embodiments of the invention is made below with reference to the accompanying figures, wherein like numerals represent corresponding parts of the figures.

FIG. 5 is a perspective view of an embodiment of the invention demonstrated in active position and in lowered open configuration.

FIG. 6 is a detail perspective view of an embodiment of the invention demonstrated in open configuration and intentionally omitting the net for illustrative clarity.

FIG. 7 is a top view of an embodiment of the invention demonstrating the rim lock and release handles and omitting multiple components for illustrative clarity.

DETAILED DESCRIPTION OF CERTAIN EMBODIMENTS

Figure 1:
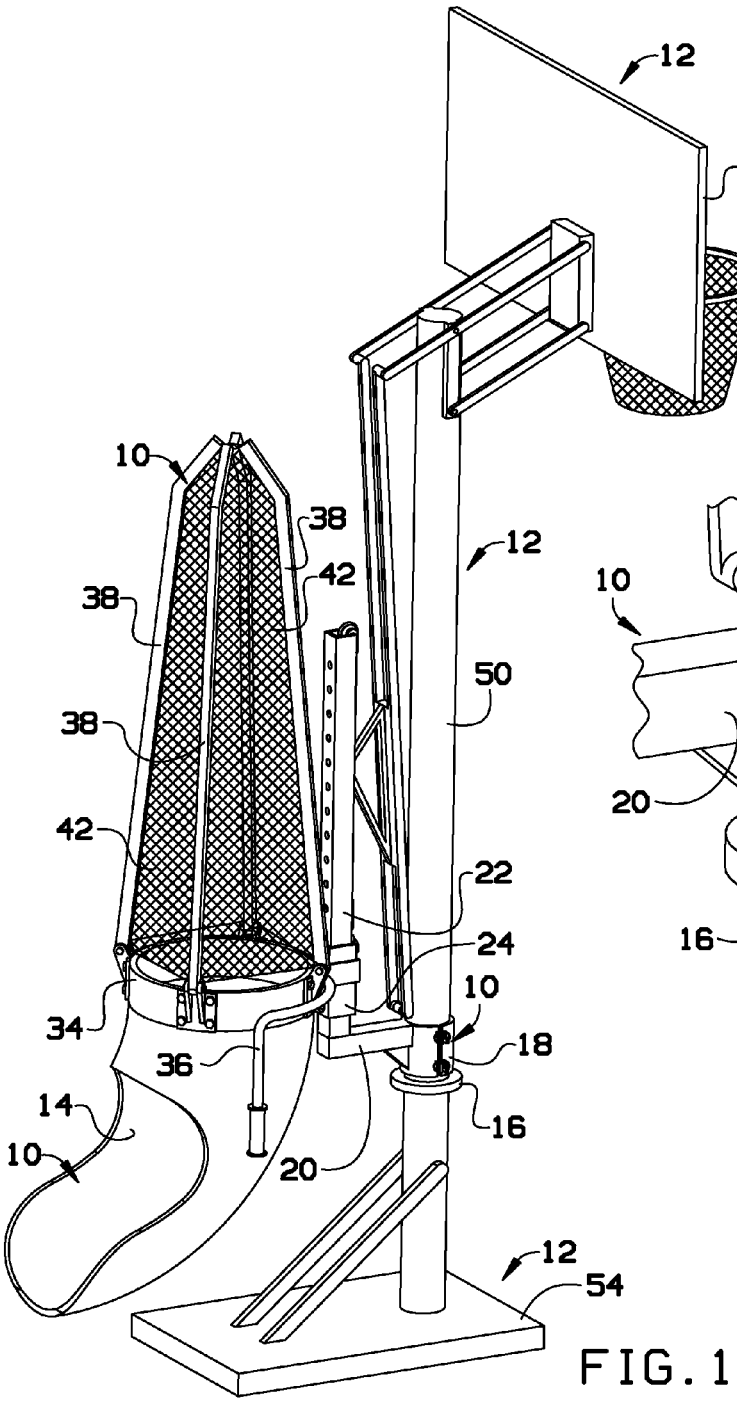
FIG. 1 is a perspective view of an embodiment of the invention demonstrated in non-active position and in closed configuration.
Figure 2:
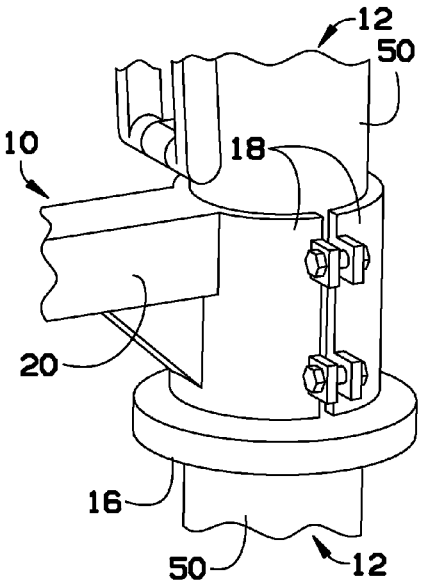
FIG. 2 is a perspective detail view of an embodiment of the invention demonstrated in non-active position and in closed configuration.
Figure 4:
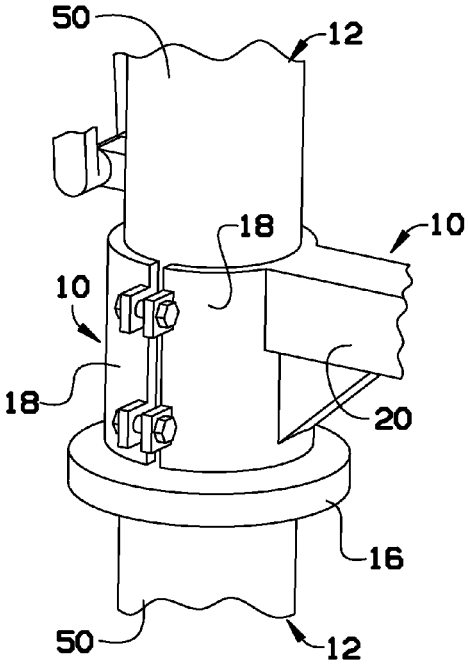
FIG. 4 is a perspective detail view of an embodiment of the invention demonstrated in active position and in closed configuration.
Figure 3:
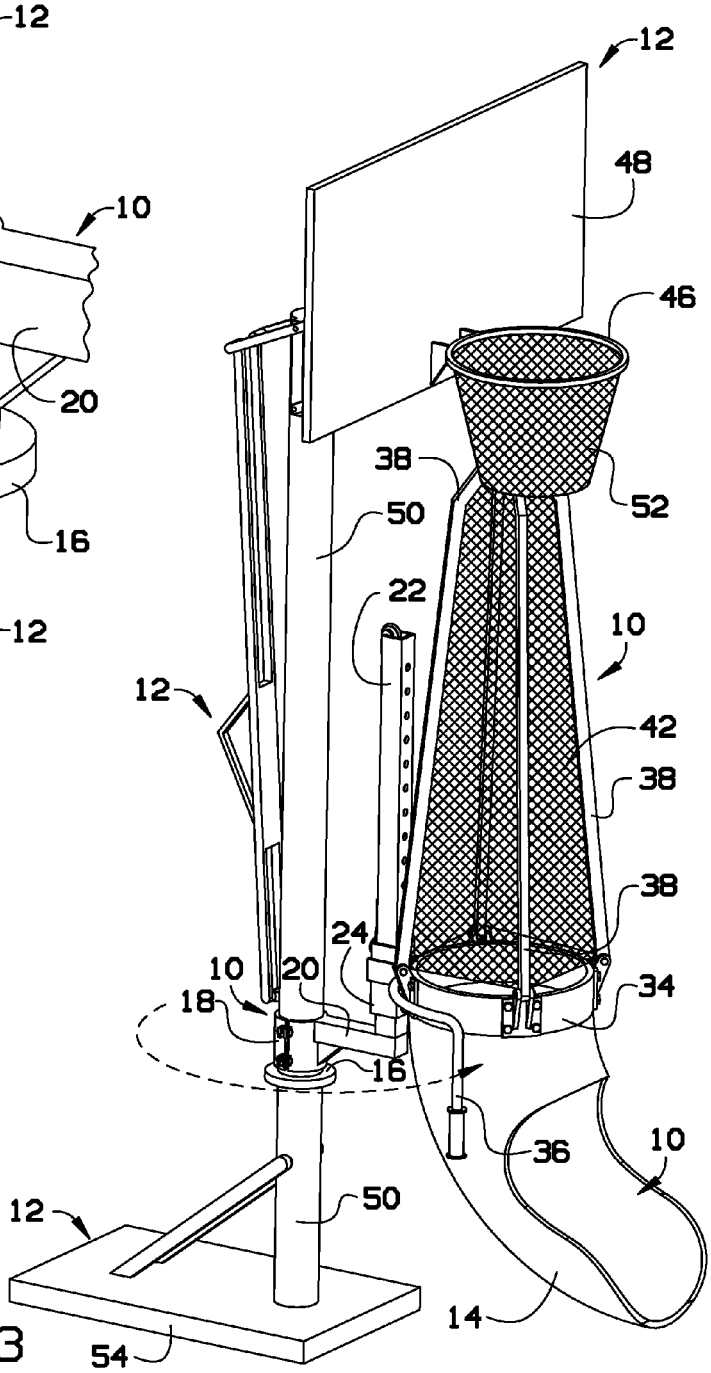
FIG. 3 is a perspective view of an embodiment of the invention demonstrated in active position and in closed configuration.
Figure 8:
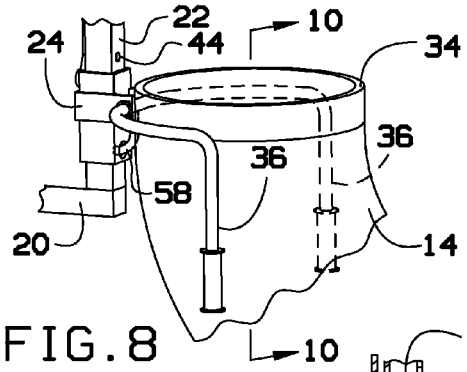
FIG. 8 is a side perspective detail view of an embodiment of the invention demonstrating the rim lock and release handles in locked position.
Figure 9:
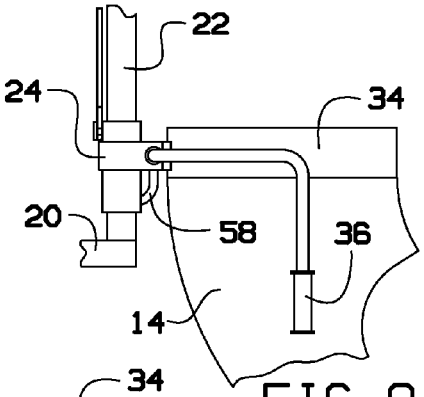
FIG. 9 is a side perspective detail view of an embodiment of the invention demonstrating the rim lock and release handles in locked position.
Figure 10:
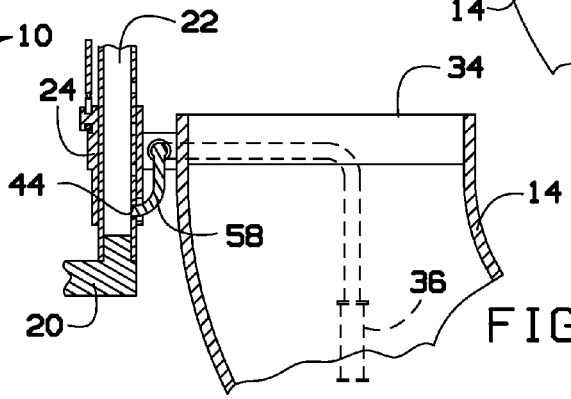
FIG. 10 is a section detail view of an embodiment of the invention along line 10-10 in FIG. 8.
Figure 11:
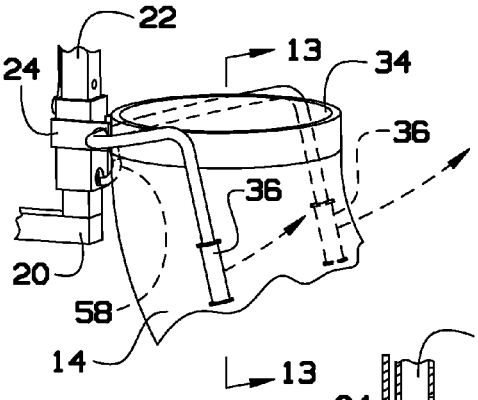
FIG. 11 is a side perspective detail view of an embodiment of the invention demonstrating the rim lock and release handles in unlocked position.
Figure 12:
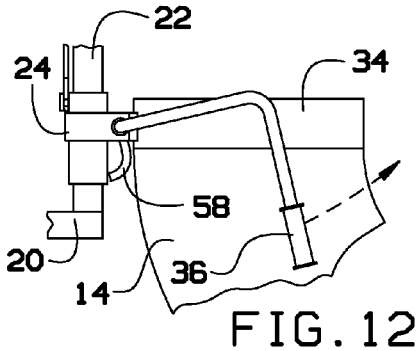
FIG. 12 is a side perspective detail view of an embodiment of the invention demonstrating the rim lock and release handles in unlocked position.
Figure 13:
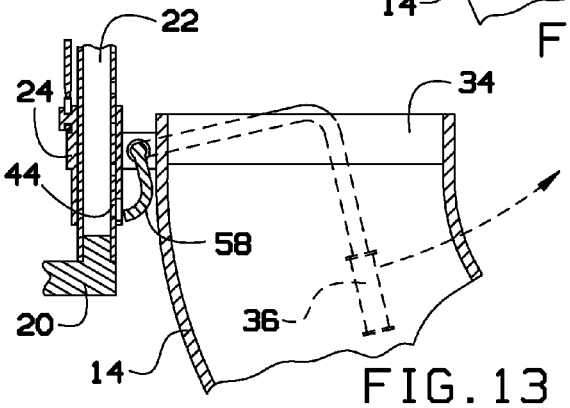
FIG. 13 is a section detail view of an embodiment of the invention along line 13-13 in FIG. 11.
Figure 14:
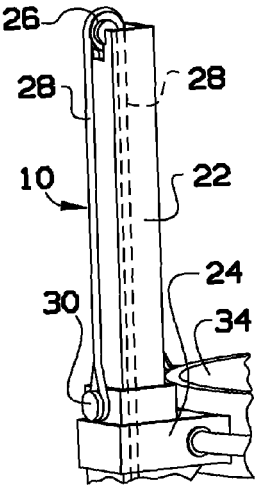
FIG. 14 is a rear perspective detail view of an embodiment of the invention.

By way of example, and referring to FIG. 1, one embodiment of the present system comprises ball recovery and release system 10 which can be attached to basketball structure 12. Basketball structure 12 comprises basketball goal pole base 54 attached to basketball goal pole goal post 50. Basketball goal pole goal post 50 is attached to basketball goal pole backboard 48. Basketball goal pole backboard 48 is attached to basketball goal pole hoop 46 which is further attached to basketball goal pole hoop net 52. Basketball structure 12 has a front where hoop 46 is located and a back which is the side opposite of hoop 46.

Turning to FIG. 2, FIG. 3, FIG. 4 and FIG. 14 ball recovery and release system 10 comprises pole clamp 16. Pole clamp 16 is attached to basketball goal pole goal post 50. The swing arm pole clamp 18 rest on top of pole clamp 16 and is attached to basketball goal pole goal post 50. Swing arm pole clamp 18 is further attached to swing arm 20.

Swing arm 20 is mechanically coupled to swing arm guide pole 22. Swing arm guide pole 22 is immediately adjacent to swing arm guide pole slide 24, which is configured to slide up and down vertically on swing arm guide pole 22. Lift assist pulley 26 is attached to swing arm guide pole 22. Lift assist swing arm guide pole slide connection 30 is attached to swing arm guide pole slide 24. The lift assist elastic cabling 28 is connected to the lift assist swing arm guide pole slide connection 30 at one end and stretched up over the top of the lift assist pulley 26 and down the middle of the swing arm guide pole 22, where it is mechanically connected at the inside bottom of the swing arm guide pole 22. The pulley system creates a mechanical advantage for raising and lowering the swing arm.

Turning to FIG. 5, FIG. 6, and FIG. 7, swing arm guide pole slide 24 is attached to rim lock and release handle shaft 58. Rim lock and release handle shaft 58 is further attached to rim lock and release handles 36.

Swing arm guide pole slide 24 is further attached to recovery rim 34. Recovery rim 34 is further mechanically coupled to a plurality of net frame pole pivot brackets 40. Each net frame pole pivot bracket 40 is rotationally coupled to a net frame pole 38. Recovery net 42 is attached to each net frame pole 38. Recovery rim 34 is further mechanically coupled to ball release chute 14.

FIG. 8, FIG. 9, FIG. 10, FIG. 11, FIG. 12 and FIG. 13 show the functionality of release handles 36. As noted above, release handles 36 are attached to release handle shaft 58. Release handle shaft 58 can travel through swing arm guide pole hole 44 which travels through swing arm guide pole slide 24 and swing arm guide pole 22. In a first mode of operation, when release handle shaft 58 travels through swing arm guide pole hole 44, then ball recovery and release system 10 is in a locked position and cannot be moved. However, in a second mode of operation, when release handle shaft 58 is removed from swing arm guide pole hole 44, then ball recovery and release system 10 is in an unlocked position and can be moved.

Figure 15:
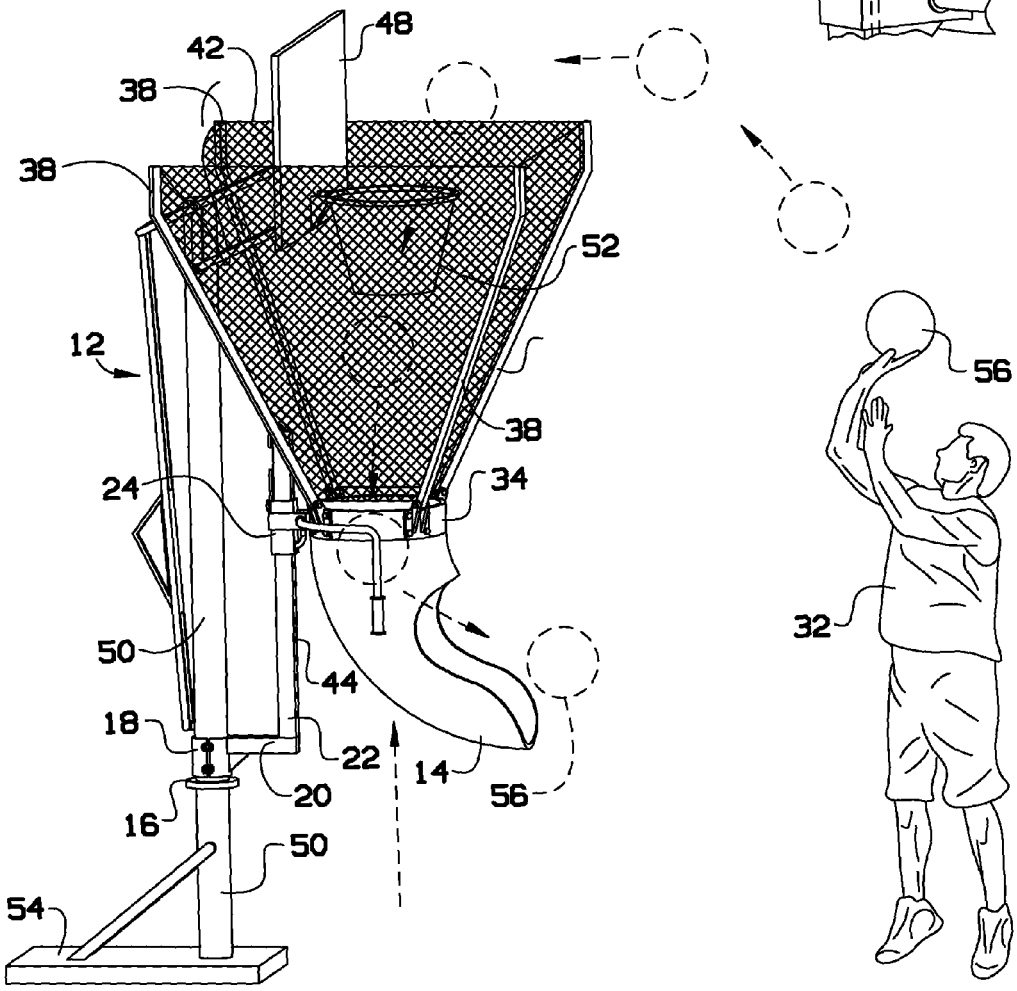
FIG. 15 is a side perspective view of an embodiment of the invention shown in active position and in the raised open configuration (shooter shown).

FIG. 15 shows ball recovery and release system 10 in use. User 32 can raise swing arm guide pole slide 24 proximate basketball goal pole hoop net 52. When user 32 shoots ball 56 proximate net 52 it will travel through recovery net 42 down through release shoot 14 and return ball 56 to user 32. This will enable user 32 to develop basketball skill.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A ball recovery and release system, configured to return a ball shot at a basketball structure; the ball recovery and release system, comprising:

a swing arm, rotationally connected to the basketball structure and configured to rotate from a back to a front of the basketball structure;

a swing arm guide pole mechanically coupled to the swing arm;

a swing arm guide pole slide, surrounding a portion of the swing arm guide pole and configured to slide vertically on the swing arm guide pole;

a lift assist pulley, attached to the swing arm guide pole;

a lift assist swing arm guide pole slide connection, attached to the swing arm guide pole slide;

a lift assist elastic cabling, connected to the lift assist swing arm guide pole slide connection at one end and stretched up over the lift assist pulley and down the middle of the swing arm guide pole, where the lift assist elastic cabling is mechanically connected at an inside bottom of the swing arm guide pole;

a recovery rim, connected to the swing arm and further attached to a chute configured to direct the ball shot at the basketball structure;

wherein the lift assist elastic cabling creates a mechanical advantage for raising and lowering the recovery rim along the swing arm guide pole;

a plurality of net frame pole pivot brackets, attached to the recovery rim;

a plurality of net frame poles, each attached to a net frame pole pivot bracket;

a recovery net connected to all of the net frame poles;

wherein the ball shot at the basketball structure travels through the recovery net and down the chute.

2. The ball recovery and release system of claim 1, further comprising:

a pole clamp attached to the basketball structure; and a swing arm pole clamp resting upon the pole clamp and attached to the swing arm;

wherein the swing arm pole clamp rotates the swing arm around the basketball structure.

3. The ball recovery and release system of claim 1, wherein the recovery rim is attached to the swing arm with the swing arm guide pole slide in order to raise and lower the recovery rim along the swing arm guide pole.

4. The ball recovery and release system of claim 1, further comprising:

a rim lock and release handle shaft mechanically coupled to the swing arm guide pole slide;

a swing arm guide pole hole in the swing arm guide pole;

rim lock and release handles attached to the rim lock and release handle shaft;

wherein a first mode of operation, the rim lock and release handle shaft is inserted through the swing arm guide pole hole in order to lock the swing arm guide pole slide into a locked position;

wherein a second mode of operation, the rim lock and release handle shaft is inserted out of the swing arm guide pole hole in order to unlock the swing arm guide pole slide into an unlocked position.

5. A ball recovery and release system, configured to return a ball shot at a basketball structure; the ball recovery and release system, comprising:

a swing arm, rotationally connected to the basketball structure and configured to rotate from a back to a front of the basketball structure;

a swing arm guide pole mechanically coupled to the swing arm;

a swing arm guide pole slide, surrounding a portion of the swing arm guide pole and configured to slide vertically on the swing arm guide pole;

a lift assist pulley, attached to the swing arm guide pole;

a lift assist swing arm guide pole slide connection, attached to the swing arm guide pole slide;

a lift assist elastic cabling, connected to the lift assist swing arm guide pole slide connection at one end and stretched up over the lift assist pulley and down the middle of the swing arm guide pole, where the lift assist elastic cabling is mechanically connected at an inside bottom of the swing arm guide pole;

a recovery rim, connected to the swing arm and further attached to a chute configured to direct the ball shot at the basketball structure;

wherein the lift assist elastic cabling creates a mechanical advantage for raising and lowering the recovery rim along the swing arm guide pole;

wherein the recovery rim is attached to the swing arm with the swing arm guide pole slide in order to raise and lower the recovery rim along the swing arm guide pole;

a plurality of net frame pole pivot brackets, attached to the recovery rim;

a plurality of net frame poles, each attached to a net frame pole pivot bracket;

a recovery net connected to all of the net frame poles;

a pole clamp attached to the basketball structure; and a swing aim pole clamp resting upon the pole clamp and attached to the swing arm;

wherein the swing arm pole clamp rotates the swing arm around the basketball structure;

wherein the ball shot at the basketball structure travels through the recovery net and down the chute.

6. The ball recovery and release system of claim 5, further comprising:

a rim lock and release handle shaft mechanically coupled to the swing arm guide pole slide;

a swing arm guide pole hole in the swing arm guide pole;

rim lock and release handles attached to the rim lock and release handle shaft;

wherein a first mode of operation, the rim lock and release handle shaft is inserted through the swing arm guide pole hole in order to lock the swing arm guide pole slide into a locked position;

wherein a second mode of operation, the rim lock and release handle shaft is inserted out of the swing arm guide pole hole in order to unlock the swing arm guide pole slide into an unlocked position.

* * * * *